US005449046A

United States Patent [19]

Kinnan

[11] Patent Number: 5,449,046

[45] Date of Patent: Sep. 12, 1995

[54] EARTH BORING TOOL WITH CONTINUOUS ROTATION IMPULSED STEERING

[75] Inventor: Frank R. Kinnan, Camas Valley, Oreg.

[73] Assignee: Electric Power Research Institute, Inc., Palo Alto, Calif.

[21] Appl. No.: 173,696

[22] Filed: Dec. 23, 1993

[51] Int. Cl.[6] ..... E21B 7/06

[52] U.S. Cl. ..... 175/24; 175/61; 175/73

[58] Field of Search ..... 175/61, 73, 24, 62

[56] References Cited

U.S. PATENT DOCUMENTS

| | | | |
|---|---|---|---|
| 3,416,613 | 12/1968 | Henderson . | |
| 3,465,837 | 9/1969 | Saunders et al. . | |
| 4,211,292 | 7/1980 | Evans | 175/73 |
| 4,537,265 | 8/1985 | Cox et al. . | |
| 4,637,479 | 1/1987 | Leising | 175/26 |
| 4,694,913 | 9/1987 | McDonald et al. . | |
| 4,714,118 | 12/1987 | Baker et al. | 175/26 |
| 4,787,463 | 11/1988 | Geller et al. . | |
| 4,858,704 | 8/1989 | McDonald et al. . | |
| 4,867,255 | 9/1989 | Baker et al. | 175/61 |
| 4,905,773 | 3/1990 | Kinnan . | |
| 4,957,173 | 9/1990 | Kinnan . | |
| 4,991,667 | 2/1991 | Wilkes, Jr. et al. | 175/61 |
| 4,993,503 | 2/1991 | Fischer et al. | 175/62 |
| 5,031,706 | 7/1991 | Spektor . | |
| 5,054,565 | 10/1991 | Kinnan . | |
| 5,148,880 | 9/1992 | Lee et al. | 175/73 X |
| 5,265,682 | 11/1993 | Russell et al. | 175/45 |
| 5,314,030 | 5/1994 | Peterson et al. | 175/26 |

FOREIGN PATENT DOCUMENTS

| | | | |
|---|---|---|---|
| 2259316 | 3/1993 | United Kingdom | 175/73 |
| 152845 | 2/1959 | U.S.S.R. . | |

*Primary Examiner*—Hoang C. Dang
*Attorney, Agent, or Firm*—Edward B. Anderson

[57] ABSTRACT

A pump pumps a drive fluid through a drill string and drill head during drilling. A movable element is mounted in the drill head for effecting a lateral movement on the drill head when moved in response to the pressure of the drive fluid in the drill head. This is in the form of pistons that are extended outwardly sideways from the drill head against the side of the borehole or an asymmetrical drill bit that applies a lateral force when a longitudinal force is applied to it. Steering is achieved by applying the lateral force when the drill head is in a selected rotational position. An indication is provided at the out-of-ground end of the drill string of the orientation of the drill head during rotation. A manually or automatically operated apparatus applies an impulse of force to the drive fluid at the out-of-ground end of the drill string when the drill head is at the selected orientation. This produces an impulse of increased pressure to the element in the drill head while the drill string is rotating. The synchronized application of a series of time-spaced lateral impulses to the drill head produces a continuous curve in the drilled borehole.

6 Claims, 7 Drawing Sheets

EARTH BORING TOOL WITH CONTINUOUS ROTATION IMPULSED STEERING

BACKGROUND OF THE INVENTION

1. Field of the Invention

This invention relates to earth boring tools and in particular to earth boring tools providing steering of a drill head while the head is rotating.

2. Related Art

The use of horizontal drilling rigs for drilling holes generally following the surface of the earth for installation of underground utilities has become well established in the last ten years. Originally, underground utilities were installed by placing a utility string of pipes, conduits, communication lines, or power cables in an open trench. Devices have also been developed that drill or push a drill string horizontally. The drill string is then used to guide boring equipment which pulls the desired utility string into the resultant borehole. This allows installation of the underground string without disturbing the earth surface between the ends of the string. These early devices are unguided.

The need for curving the underground bore in order to avoid underground and surface structures and generally control the path of the borehole soon became clear. This was provided by the use of special drill heads that could be externally controlled to bend, and thereby change the direction of the drill head.

Another scheme developed involves the use of a drill bit that is longitudinally slanted or wedge-shaped. When it is desired to change direction, the rotation of the drill head is stopped, the head is oriented to produce movement in a desired diverging direction, and the drill head is pushed into the earth. This changes the direction of the drill head. When rotation of the drill head resumes, the drill head is travelling in an altered direction. When performed repeatedly, the drill string can be directed to follow a curved path.

Such a system is effective for drilling through soil, but is not effective if the soil is quite soft or if rock or other hard material is encountered. Also, the system is relatively slow in that rotation of the drill string, which produces the advance in the borehole, must be stopped while the steering maneuver is performed. The greater the changes in borehole direction that are required, the slower the progress. Additionally, it takes more energy to stop and start rotation since the static friction between the drill string and borehole is greater than the dynamic friction. Further, when the drill string stops, drill shavings tend to impact between the drill string and borehole surface, a phenomena referred to as collaring. This further resists movement of the drill string in the borehole.

Such systems are also clearly not suitable for any but the most basic soil conditions. If a hard material such as rock is encountered or if particularly soft material such as sand is encountered, then this technique cannot be used. There thus is a need for a simple horizontal drilling system that overcomes these disadvantages of conventional drilling techniques.

SUMMARY OF THE INVENTION

Various features of the present invention overcome these disadvantages of the known art. The present invention provides steering of a drill head while continuously rotating the drill head. Further, a drill head made according to a preferred form of the invention provides for drilling through hard and soft materials, and provides for applying a steering force downhole or at the drill rig.

These features are provided in the present invention by a method and apparatus for drilling a borehole through earth along a curved line. A drill string and a drill head fixed to an in-ground end of the drill string are rotated about a longitudinal axis. A longitudinal driving force is applied to the drill string while the drill string is rotating for drilling a borehole in a substantially straight line. A lateral impulse of force is applied to the drill head while the drill string is rotating. This impulse is applied when the drill head is substantially in a selected rotational orientation. The line of the borehole is thereby diverted from the straight line toward a selected direction.

In the preferred embodiment of the invention, the steering apparatus includes a pump for pumping a drive fluid through the drill string and the drill head during drilling. A movable element is mounted for movement in the drill head for moving the drill head laterally when moved in response to the pressure of the drive fluid in the drill head. This can be in the form of one or more pistons that are extended outwardly sideways from the drill head, or an asymmetrical drill bit that applies a lateral force when a longitudinal force is applied to it when it is in a selected rotational position.

An indication is provided at the out-of-ground end of the drill string of the orientation of the drill head during rotation. A manually or automatically operated intensifier applies an impulse of force to the drive fluid at the out-of-ground end of the drill string when the drill head is at a selected orientation. This fluid impulse moves the element in the drill head while the drill string is rotating. This causes the drill head to drill toward the selected direction.

This device also provides for the coordinated application of a series of time-spaced lateral impulses to the drill head so that the drill head is redirected in a selected direction. The greater the change in direction or the harder the material being drilled through, the more the number of impulses required to effect the desired course change. However, these course changes are made while the drill string is rotated, so there is no interruption of the overall drilling operation.

These and other features and advantages of the present invention will be apparent from the preferred embodiments described in the following detailed description and illustrated in the accompanying drawings.

DETAILED DESCRIPTION OF THE PREFERRED EMBODIMENT

Figure 1:
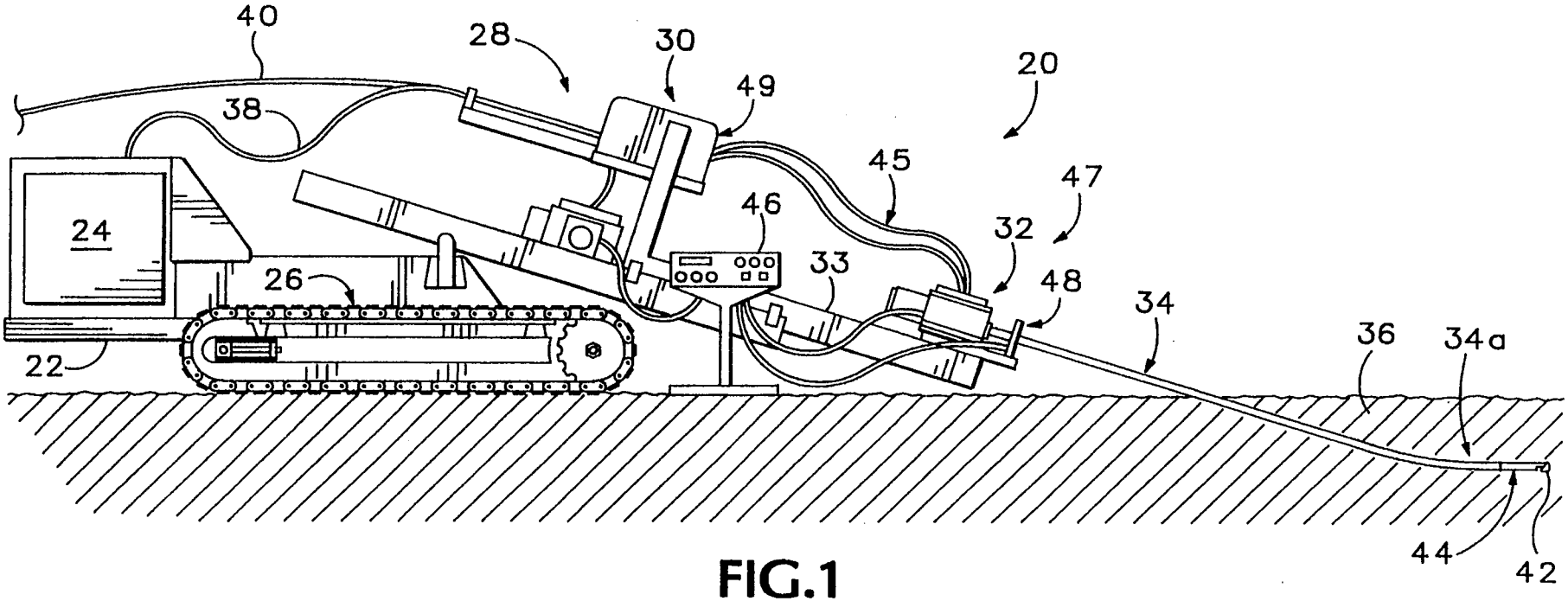
FIG. 1 is a side view of a drilling apparatus made according to the invention.

Referring initially to FIG. 1, a drilling apparatus 20 made according to the invention includes a chassis 22 which supports a motor 24 for driving tractor treads 26 used for positioning a drilling assembly 28 during drilling. Apparatus 20 is made and operated according to conventional practice except for the features specifically described herein. Motor 24 also drives a hydraulic system coupled to a pipe driver 30 for moving a pipe rotator 32 along a tiltable ramp 33 for driving a drill string 34 into the earth, shown generally at 36. Rotator 32 receives hydraulic lines 38 for rotating drill string 34 during drilling. A drill fluid line 40 is used to pump a suitable drill fluid, typically water or a water and bentonite slurry into the drill string to flush the drill shavings from around a drill bit 42 mounted on the distal end 44*a* of a drill head 44 mounted on the distal end 34*a* of the drill string. This path of drill fluid is referred to as drill fluid circuit 45. A control panel 46 is used to position drilling assembly 28 at a drill site and to control the various drilling operations. A steering assembly 47, including an impulse controller 48 and an impulse producer or intensifier 49, is used to steer the drill string as described below.

Figure 2:
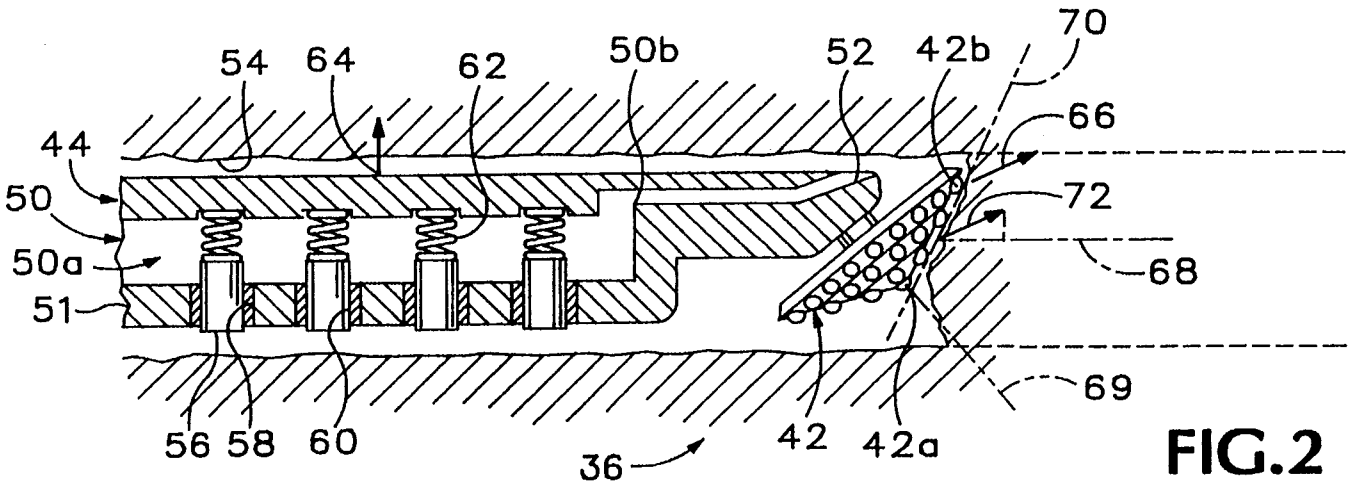
FIG. 2 is a cross section of a first embodiment of a drill head useable in the apparatus of FIG. 1 operating in a non-steering mode.
Figure 3:
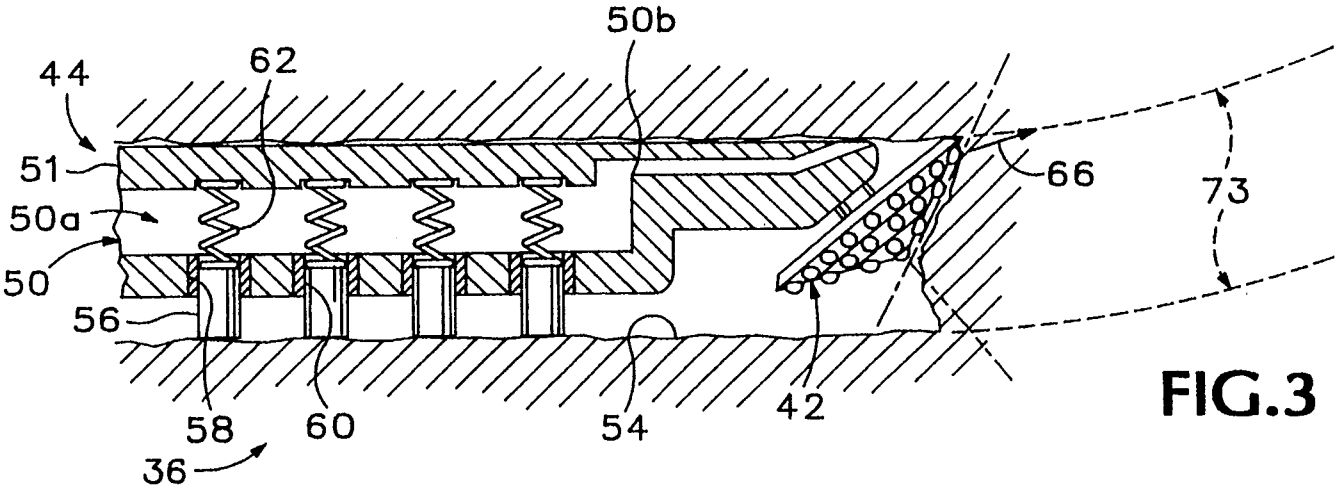
FIG. 3 is a cross section of the embodiment of FIG. 2 during application of a steering impulse.

FIGS. 2 and 3 illustrate the distal end of one preferred embodiment of a drill head 44 for practicing the method of the invention. This drill head includes a fluid channel 50 formed in a body 51 of the same size as the drill string. The channel couples the fluid supplied through the drill string to an outlet port 52 through which the drill fluid is applied directly to the end of a borehole 54 formed by drill bit 42. Channel 50 includes an enlarged portion 50*a* and a restricted port 50*b* between the wide portion and the outlet.

A plurality of pistons, such as piston 56 are disposed in respective laterally oriented cylinders, such as cylinder 58. Each cylinder extends through the sides of the drill head between enlarged portion 50*a* of channel 50 and borehole 54 and preferably has a copper sleeve 60 lining it to reduce wear. The pistons are attached to springs, such as spring 62, the opposite ends of which are attached to the opposite side of the drill head as shown.

During normal, non-steering operation, with the drill fluid passing through channel 50 to outlet port 52, the spring constant is appropriate under the fluid pressure to support the pistons within the wall of the drill head, as shown in FIG. 2. When a higher pressure is applied to the fluid, restricted port 50*b* limits the flow of the fluid out of enlarged portion 50*a*, thereby applying a substantial portion of the increased pressure to the bases of the pistons. The fluid pressure overcomes the retaining force of springs 62 and forces the springs out beyond the sides of the drill head.

With a sufficient increase in the fluid pressure, the pistons are projected against the surface of the borehole, as shown in FIG. 3. When the pistons hit the borehole surface a lateral force opposite from the pistons is applied to the drill head, as represented by arrow 64. This force is correspondingly applied directly to drill bit 42, causing a slight drilling action at a lateral angle. The longitudinal force applied to the drill string during straight drilling may be applied while the lateral impulse is applied. If so, the resultant force at the moment of the impulse is at a slight net lateral angle as represented by arrow 66.

The preferred drill bit 42, as shown in FIGS. 2–5, is similar to a roller cone used in a conventional tri-cone drilling head. The forward edges of the three roller cones on a conventional head are substantially coplanar along a plane generally normal to the longitudinal axis 68 of the drill head. A longitudinal force applied to such a drill head results in straight drilling. A lateral force, such as applied by pistons 56, would, however, steer it. Similarly, when a single conventional roller cone is used, it has been found that there is a slight lateral force applied when used in the method of the present invention, probably due to the larger periphery of impact around the base of the cone.

The effectiveness of the roller cone is further improved by increasing the angle of the cone, which rotates about axis 69, to the configuration of bit 42 shown in these figures. The modified bit is then mounted to the end of the drill head so that the leading edge, represented by line 70, is offset with the center tip 42*a* longitudinally recessed compared to the outer rim or base 42*b*. This gives the leading edge a general wedge shape that inherently produces a sideways torque, as represented by net force arrow 72. The base of the cone extends beyond the edge of the drill head so that, during rotation, it drills a borehole that has a cross-sectional area larger than the cross-sectional area of the pipe forming the drill head body and drill string.

When both the set of pistons 56 and angled roller cone bit 42 are used, a doubly increased lateral impulse force is applied to the drill head. Repeated applications of the fluid impulse when the drill head is in the same orientation for numerous rotations produces a borehole having a curved path represented by dashed lines 73 shown in exaggerated form for purposes of illustration.

Figure 4:
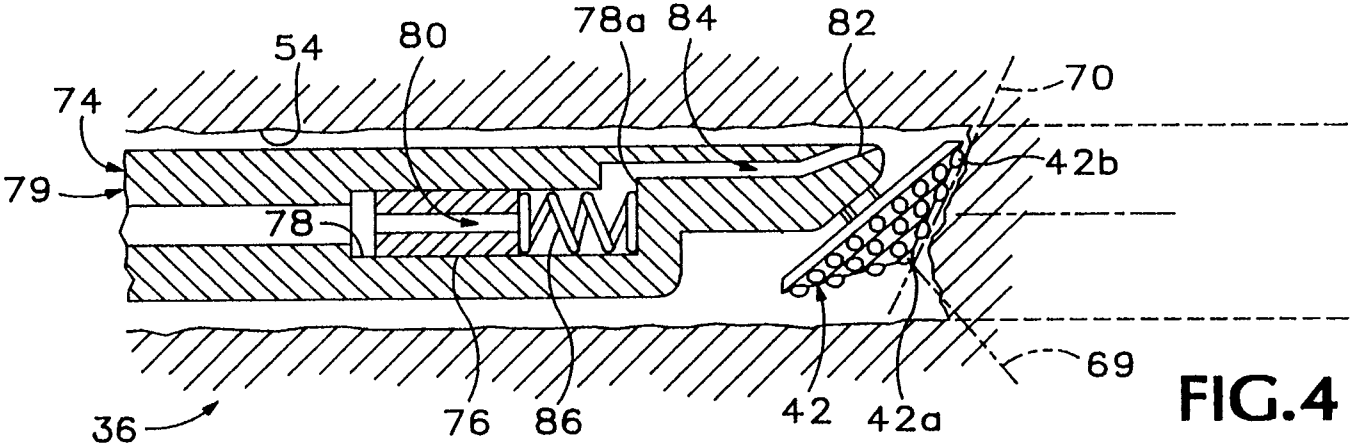
FIG. 4 is a cross section of a second embodiment of a drill head useable in the apparatus of FIG. 1 operating in a non-steering mode.
Figure 5:
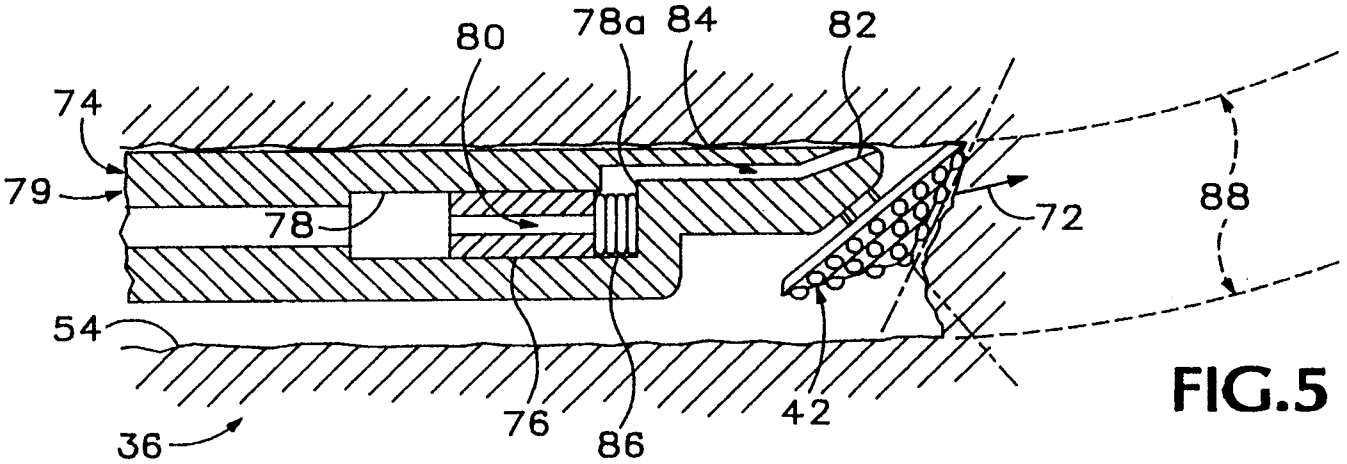
FIG. 5 is a cross section of the embodiment of FIG. 4 during application of a steering impulse.

FIGS. 4 and 5 illustrate a drill head 74 that is an alternative to the embodiment of FIGS. 2 and 3. This drill head simply uses drill bit 42 to apply the lateral force to the drill head. Instead of the laterally movable pistons, drill head 74 has a longitudinally movable piston or hammer 76 that rides in a longitudinally extending fluid cylinder 78 in a drill head body 79. Hammer 76 has a central open passageway 80 that allows drill fluid to be pumped through it during straight drilling. The drill fluid moves to an outlet port 82 via a terminal channel 84 coupled to cylinder 78.

Passageway 80 has a substantially reduced cross-sectional area compared to that of cylinder 78. As a result when an impulse of force is applied to the drill fluid circuit, the reduced area of the passageway forces the increased fluid pressure to be applied to the upstream face of the hammer. It is important, in order to create a reduced cylinder fluid pressure downstream from the piston, that terminal channel 84 have a larger cross-sectional area than the piston passageway. This assures that the increased fluid pressure will always apply a force on the hammer directed toward drill bit 42.

This longitudinal force on the hammer is resisted by a spring 86. Spring 86 is captured between the distal end of the piston and distal end 78*a* of the cylinder, also referred to as an anvil. FIG. 4 shows operation of drill head 74 during straight drilling when a moderate drill fluid pressure exists. Spring 86 is expanded and holds hammer 76 away from the distal end of the cylinder. When an impulse of force greater than the resistive force of the spring is applied to the drill fluid circuit, the spring collapses and the hammer hits spring 86 against anvil 78*a* of the cylinder with a heavy blow. This forces the drill bit into the end of the borehole.

As has been described, the transverse slope of the leading edge of the roller cone bit imparts a transverse force on the bit causing it to drill at an angle slightly transverse to the longitudinal axis of the drill head. So long as the applied impulse is of a very short duration, the lateral drilling occurs over a small rotational arc of the drill bit as the drill bit turns. Dashed lines 88 illustrate at a larger than realizable angle the path of the drill head resulting from continued application of the fluid impulse when the drill head is in the orientation shown during each of numerous rotations of the drill string.

It should further be noted that the present invention can also be practiced on a drill head not having hammer 76 or spring 86. The impulse of force may be applied directly to the drill string pipes by a modified drill rig, not shown, but known to be of conventional construction as relates to the capability of applying such a force. Other methods of applying the longitudinal force to the drill head may be used. For instance, the fluid impulse itself applies such a force. The use of drill bit 42 forced against the end of the borehole, produces the necessary lateral drilling force, as has been described with reference to FIGS. 4 and 5.

Figure 6:
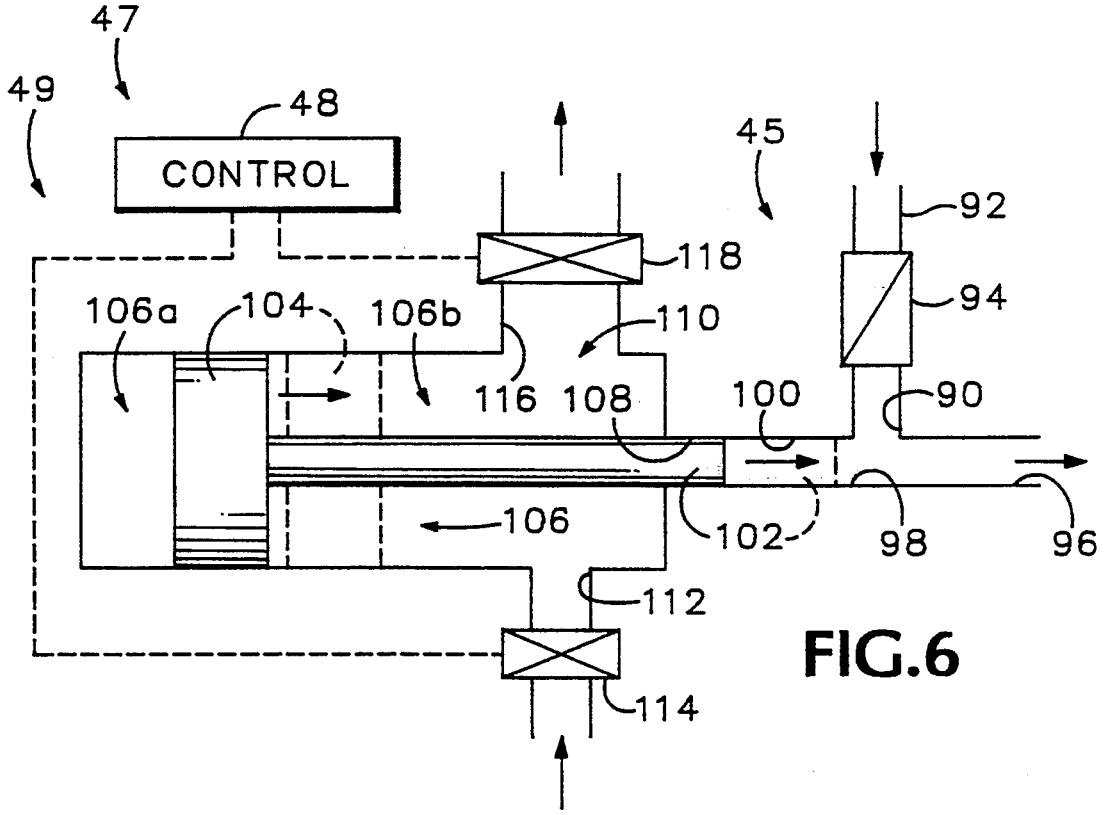
FIG. 6 is a simplified diagram showing the functional features of a drill fluid intensifier useable in the apparatus of FIG. 1.

FIG. 6 illustrates simplistically the structure of intensifier 49 for applying the impulses to drill fluid circuit 45. The drill fluid from the unillustrated source is feed into a side inlet 90 of a feed pipe 92 via a check valve 94 that prevents back flow of fluid from the feed pipe. An outlet 96 of the feed pipe is connected to drill string 34.

Between the inlet and outlet is an impulse inlet 98. Connected to inlet 98 is a small cylindrical region 100 of pipe preferably in line with outlet 96. A correspondingly small piston 102 is slidingly received in pipe portion 100. The opposite end of the piston is attached to a large piston 104. Piston 104 is captured slidingly in a correspondingly large cylinder 106.

Cylinder 106 has a closed end 106*a* that is filled with a compressible gas, such as air or more preferably nitrogen. The other, small piston end 106*b* has an opening 108 through which small piston 102 passes. The small piston end of the large cylinder is a control fluid chamber 110. An incompressible control fluid, such as hydraulic fluid is pumped into chamber 110 through an inlet port 112 which can be closed off by a valve 114. Fluid flow through a large capacity outlet port 116 is controlled by a valve 118. Both valves are controlled by impulse controller 48.

Controller 48 initially opens inlet valve 114 and closes outlet valve 118. This forces large piston 104 to move against the nitrogen gas, compressing it. When a sufficient pressure is achieved, inlet valve 114 is closed. When it is desired to apply the impulse to the drill fluid circuit, valve 118 is rapidly opened, allowing the pressurized nitrogen to rapidly force the large piston through cylinder 106, thereby ramming the small piston into pipe section 100. Since the drill fluid is relatively incompressible, the force of impact of the small piston on the fluid results in a pressure impulse being applied throughout the fluid circuit. Further, since the nitrogen remains under pressure, subject to expansion when the small piston moves against the drill fluid, an increased pressure is maintained until outlet valve 118 is closed and control fluid is again applied through inlet valve 114. Thus, the duration of the impulse is determined by the time between the opening of valve 118 and the repressurization of the control fluid chamber. This duration must be sufficiently short to limit the application of the impulse to the drill head while the drill head travels a limited arc.

Figure 7:
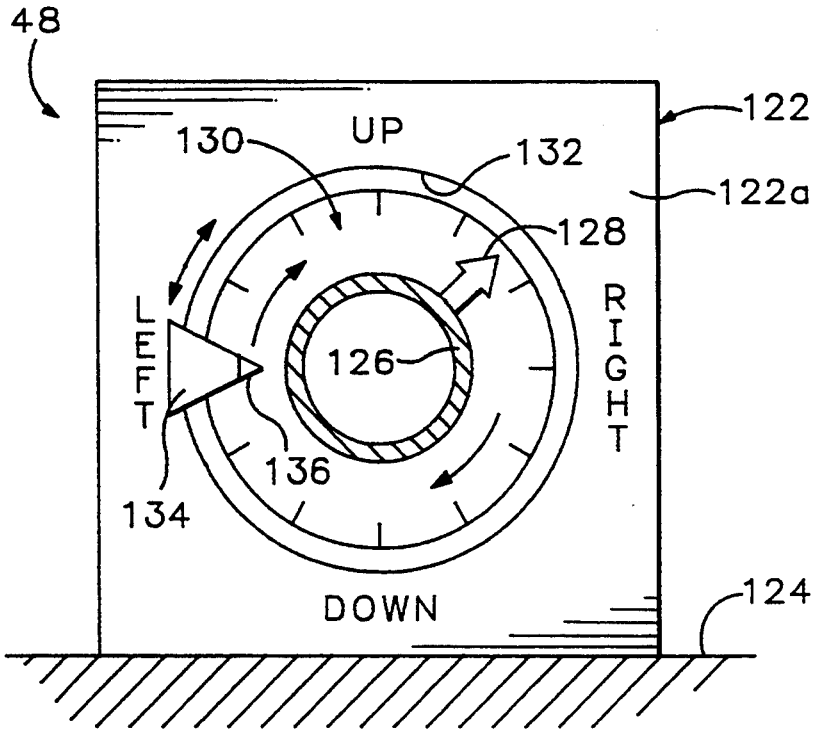
FIG. 7 is a view of an impulse controller useable in the apparatus of FIG. 1.

A face view of impulse controller 48, shown from the side in FIG. 1, is shown in FIG. 7. This is a basic controller that is positioned on the end of the drill string at the drill rig, and can be used for manual or automatic control of the impulse application. It includes a housing 122 mounted to a frame 124 attached to pipe rotator 32 for sliding on ramp 33. A drill string pipe 126 passes through the center of a face 122*a* of the housing. A marker or other indicia, such as arrow 128 is mounted on pipe 126 to indicate the orientation opposite from the set of pistons 56 if the embodiment of FIGS. 2 and 3 is used, or the orientation of the drill bit if the embodiment of FIGS. 4 and 5 is used.

The face of the controller housing 122 is imprinted with circumferential-position-indicating indicia 130. The indicia shown indicates general directions, such as up, down, left and right. Angle indicia or clock-face indicia may also be used. A circumferential slit 132 extends around the pipe and is used to selectively mount an orientation selector unit 134. Unit 134 has a face in the form of a triangle pointing toward pipe 126.

If the impulse is applied through manual controls, then the orientation selector unit is simply used to prompt the application of the impulse when or just prior to when pipe-mounted arrow 128 aligns with the tip of unit 134.

If an automatic impulse controller is used, orientation selector unit 134, which is manually positionable around slit 132, has a suitable sensor or detector 136 that senses when the tip of arrow 128 passes it. Thus, any delays in the system before the impulse is actually applied, or to compensate for wrap or twisting of the pipe string should be compensated for in selecting a position for the selector unit. Sensor 136 can be of any conventional type, such as opto-electronic, magnetic, or mechanical.

Figure 8:
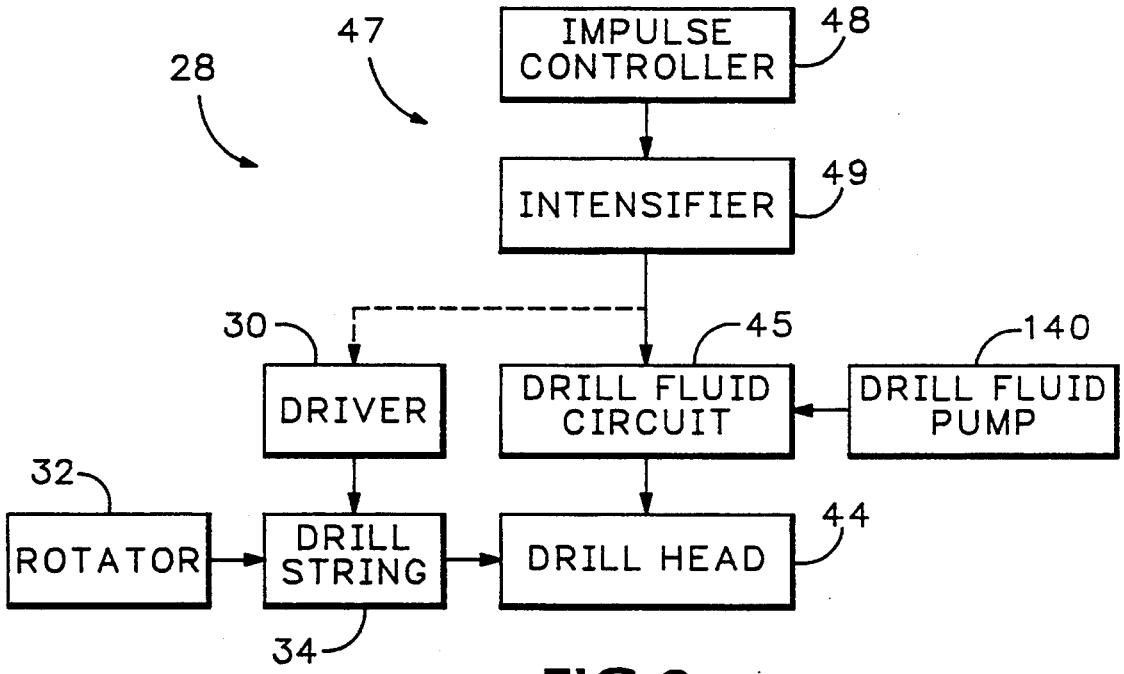
FIG. 8 is a block diagram illustrating the functions of the apparatus of FIG. 1.

FIG. 8 shows in block diagram form the components of drilling assembly 28. As has been mentioned, drill head 44 is connected to and driven by drill string 34. Pipe driver 30 applies a longitudinal drilling force to the pipe string while rotator 32 rotates the drill string. The process of rotating the drill string while the drill string is under pressure, either constant or impulsed, from the driver accomplishes the drilling.

A drill fluid pump 140 pumps the drill fluid through the drill fluid circuit 45 which runs through the drill string to the drill head, as has been described. An impulse controller such as controller 48 produces an impulse control signal that is transmitted to intensifier 49. Intensifier 49 then produces the fluid impulse, preferably synchronized with the rotation of the drill head to produce a desired steering of the drill head.

An alternative embodiment of the invention is shown by the dashed line in FIG. 8. In this embodiment, the impulse is not applied to the drill fluid circuit, but rather is applied directly to the drill string through driver 30.

This would require a drill head having a bit like bit 42 that has an asymmetric leading edge.

Figure 9:
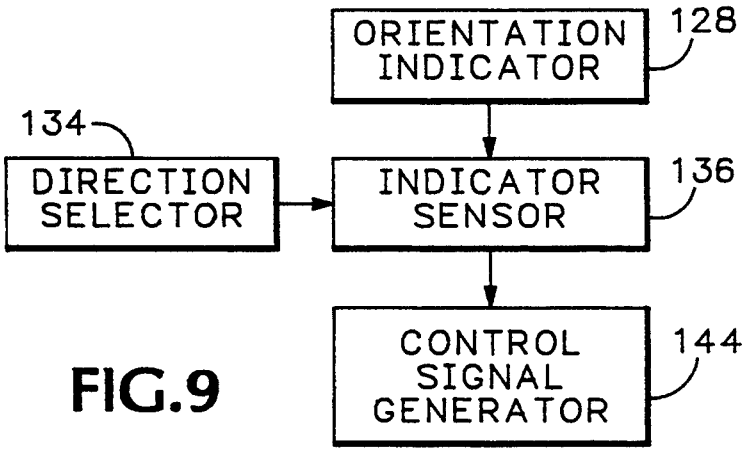
FIG. 9 is a block diagram showing in further detail the functions of the impulse controller of FIG. 7.

FIG. 9 illustrates in block form the main elements of impulse controller 48 as an automatic controller. Arrow 128 functions as an orientation indicator. Orientation selector unit 134 is a direction selector and arrow detector 136 is an indicator sensor. Sensor 136 outputs an orientation signal representative of the orientation of the drill head relative to a selected direction to a control signal generator 144. Generator 144 generates an impulse control signal for controlling the generation of a steering pulse by the intensifier.

Figure 10:
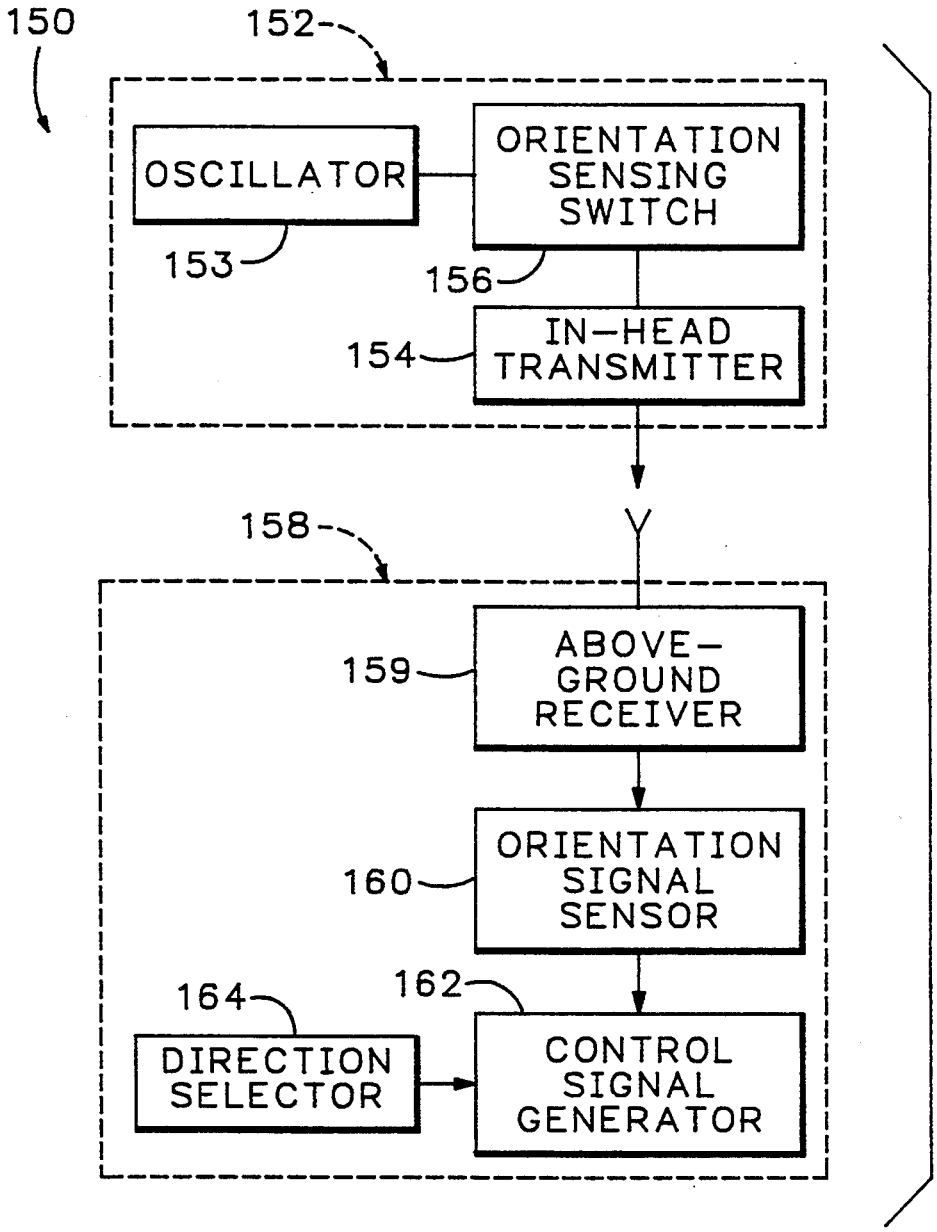
FIG. 10 is a block diagram showing an alternative embodiment of an impulse controller useable in the apparatus of FIG. 1.

An impulse controller 150 that provides impulse generation control based directly on the actual drill head orientation is illustrated in FIG. 10. Controller 150 includes an orientation signal transmission system 152, also known in the industry as a probe or sonde, is embedded in the drill head. An oscillator 153 feeds an oscillating signal to an in-head transmitter 154 via a gravity-operated switch 156, such as a mercury switch. The switch either opens or closes only when the drill head is oriented upwardly (or relative to another preset orientation). The transmitted oscillator frequency is thus either interrupted or generated only when the drill head is in the upward direction while the switch is closed.

This orientation signal is received by an above ground receiver system 158. In particular, a receiver 159 receives the signal and transmits it to an orientation signal sensor 160. Sensor 160 then produces an orientation signal indicative of the upward orientation of the drill head. A control signal generator 162 is responsive to the orientation signal and a direction selector 164 for generating the intensifier control signal.

Figure 11:
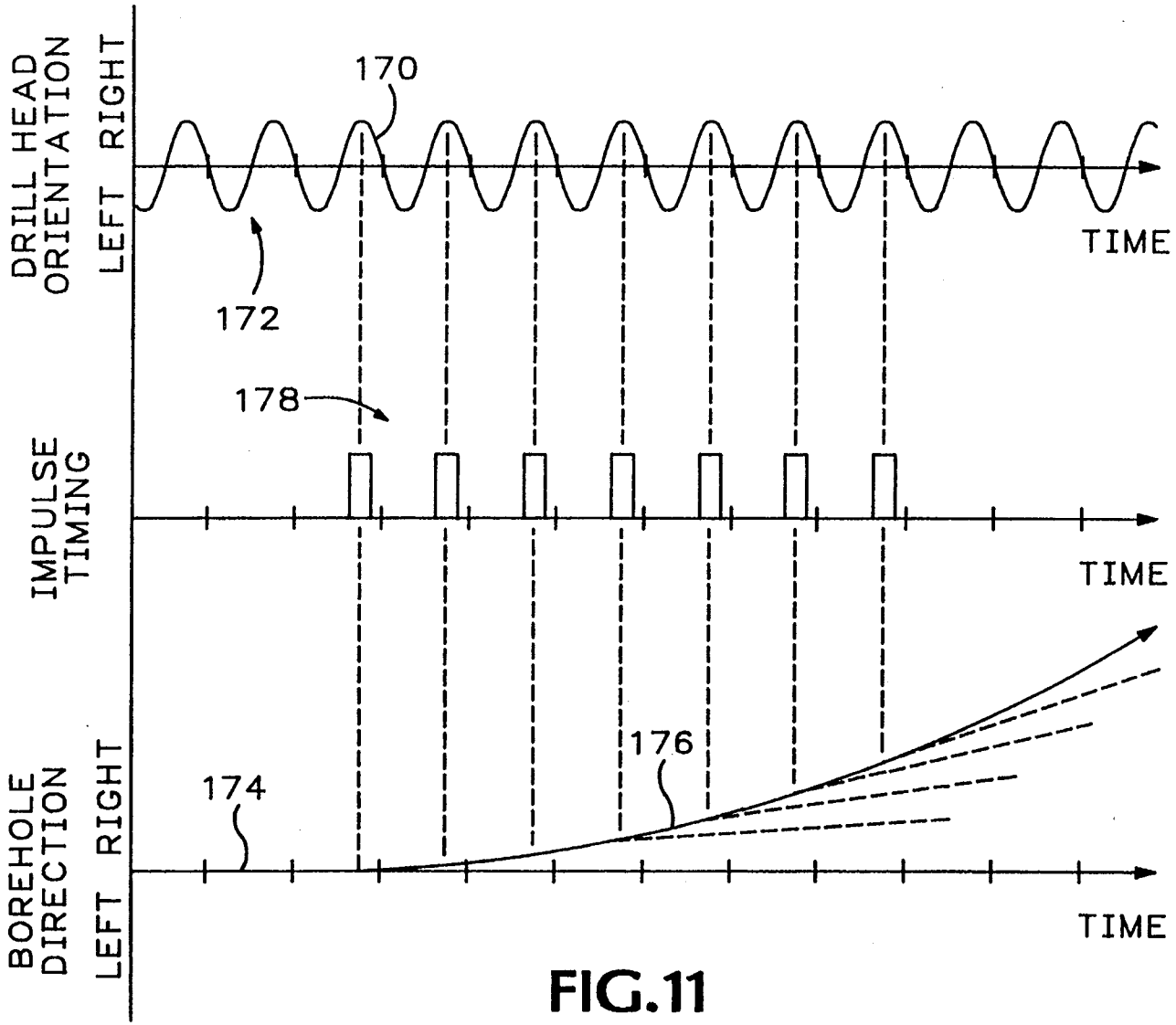
FIG. 11 is a composite graph illustrating the preferred method of practicing the invention using the apparatus of FIG. 1.

The repeated operation of drilling apparatus 20 for achieving steering of a rotating drill head according to the invention is shown by a set of timing graphs in FIG. 11. Line 170 of the top graph represents as a sine wave the rotation of drill head 44 or 74, with the top peak representing orientation to the right, the bottom peak representing orientation to the left, and the time axis crossings alternatingly representing orientations up and down.

During a first period of time shown generally at 172 no impulses are applied to the drill head and drilling is performed in a straight line, as shown by corresponding portion 174 of bottom curve 176, which illustrates the direction of the borehole, as drilled by the drill head, over the same period of time.

Assuming that it is desired to divert the borehole to the right, then the direction selector is adjusted to indicate this orientation. Thereafter, a series of impulses shown generally at 178 are applied to the drill head, as has been explained, when the drill head is oriented to the right. The vertical dashed lines show the synchronization of the impulses with the right-directed orientations of the drill head, and the resultant shift in the direction of the borehole.

It will be understood that the change in the angle of the borehole is significantly exaggerated in order to illustrate the operation of the invention. Normally, particularly for drilling in rock, each impulse application produces only a very small change in borehole direction. By continuously repeating the synchronized impulses significant steering is and has been achieved.

It should also be noted that if the intensifier does not cycle fast enough to apply an impulse once every revolution of the drill head, then the impulse can be applied every Nth revolution, as appropriate. So long as the head orientation is the same at each impulse, a gradual turn in direction is achieved.

The present invention, thus provides a method of steering a drill head by applying a lateral impulse to the drill head as it is rotating. The lateral impulse diverts the direction of the borehole. Repeated synchronized impulses achieve a desired significant change in direction. The dynamic steering of the drill head improves operating efficiency and productivity compared to conventional techniques that require steering maneuvers to be performed when the drill head is not rotating. Further, drilling complications, such as collaring are reduced. The use of a roller cone also allows steering to be accomplished while or as well as drilling through rock.

It will be apparent to one skilled in the art that variations in form and detail in addition to those specifically described may be made in the preferred embodiment without varying from the spirit and scope of the invention as defined in the claims and any modification of the claim language or meaning as provided under the doctrine of equivalents. The preferred embodiments are thus provided for purposes of explanation and illustration, but not limitation.

I claim:

1. A method of drilling a borehole through earth along a curved line using a drill head fixed to an in-ground end of a drill string, the drill head having an element movable in the drill head and there being a circuit of drive fluid extending from a drill rig through the drill string to the drive head, the movable element being movable in response to the pressure of the drill fluid between a retracted position and an extended position, said method comprising the steps of:

rotating the drill string and the drill head about a longitudinal axis;

applying a longitudinal driving force to the drill string while the drill string is rotating, and thereby drilling a borehole in a substantially straight line; and applying an impulse of force to the drill head while the drill string is rotating, which impulse is applied when the drill head is substantially in a selected rotational orientation, and thereby diverting the line of the borehole from the straight line toward a selected direction by driving at the drill rig a piston into a cylinder containing drive fluid in communication with the drive fluid circuit, and thereby moving the movable element from the retracted position to the extended position.

2. A method according to claim 1 wherein said step of applying an impulse further comprises driving the piston out of the cylinder against an energy-storage means, and applying the impulse to the drive fluid by releasing stored energy from the energy-storage means.

3. A method according to claim 2 wherein said step of driving the piston comprises driving the piston against a compressible fluid.

4. An apparatus for drilling a borehole through earth along a curved line comprising;

a drill string having an out-of-ground end and an in ground end associated with the end of a borehole being drilled;

a drill head mounted on the in ground end of said drill string for drilling the borehole;

means coupled to said out-of-ground end of said drill string for rotating said drill string and said drill head about a longitudinal axis;

means for applying a longitudinal driving force to said drill string while said drill string is rotating, and thereby drilling a borehole in a substantially straight line; and means for applying an impulse of force to said drill head while said drill string is rotating, which impulse is applied when said drill head is substantially in a selected rotational orientation, and thereby diverting the line of the borehole from the straight line toward a selected direction, said applying means comprising a chamber disposed in said drill head, means defining a circuit of drive fluid extending between said out-of-ground end of said drill string and said chamber, an element responsive to fluid pressure in said chamber for moving between a retracted position and an extended position, and means for applying an impulse to said drive fluid at the out-of-hole end of said drill string for moving said element comprising a cylinder mounted relative to said out-of-ground end of said drill string and having one end in fluid communication with said drive fluid circuit, a piston mounted in said cylinder, and means for selectively driving said piston in said cylinder toward said one end for producing said impulse in said drive fluid.

5. An apparatus according to claim 4 wherein said driving means comprises an energy storage means coupled to said piston opposite from said one cylinder end and means for moving said piston in said cylinder against said energy storage means for storing energy in said energy storage means, and said moving means being operable for releasing said piston, and thereby allowing said energy-storage means to drive said piston toward said one end of said cylinder.

6. An apparatus according to claim 5 wherein said energy-storage means comprises a compressible fluid.

* * * * *